US010991216B1

(12) United States Patent
Alali et al.

(10) Patent No.: US 10,991,216 B1
(45) Date of Patent: Apr. 27, 2021

(54) AUDITORY AND VISUAL GUIDANCE SYSTEM FOR EMERGENCY EVACUATION

(71) Applicants: Khaled Alali, Safat (KW); Khaled Alhazza, Safat (KW)

(72) Inventors: Khaled Alali, Safat (KW); Khaled Alhazza, Safat (KW)

( * ) Notice: Subject to any disclaimer, the term of this patent is extended or adjusted under 35 U.S.C. 154(b) by 0 days.

(21) Appl. No.: 17/111,737

(22) Filed: Dec. 4, 2020

(51) Int. Cl.
*G08B 7/06* (2006.01)

(52) U.S. Cl.
CPC ..... *G08B 7/066* (2013.01); *G08B 7/062* (2013.01)

(58) Field of Classification Search
None
See application file for complete search history.

(56) References Cited

U.S. PATENT DOCUMENTS 4,723,784 A * 2/1988 Muscat ..... B62B 7/04 280/47.38
5,530,330 A * 6/1996 Baiden ..... G05D 1/0234 318/580
5,565,843 A * 10/1996 Meyvis ..... G08B 5/36 340/326
5,710,543 A * 1/1998 Moore ..... G08B 5/36 340/691.7
5,999,865 A * 12/1999 Bloomquist ..... G05D 1/0248 299/1.05
6,104,428 A * 8/2000 Lu ..... G08B 13/19645 348/159
6,114,948 A * 9/2000 Astell ..... G08B 5/36 340/286.05
6,472,994 B1 * 10/2002 Tatar ..... F21S 9/022 340/332
6,762,686 B1 * 7/2004 Tabe ..... G08B 25/08 340/541
6,809,642 B1 * 10/2004 Brenner ..... G08B 7/062 340/3.1
7,425,946 B1 * 9/2008 Britton ..... G06F 1/3203 345/156

(Continued)

FOREIGN PATENT DOCUMENTS

KR 20170053910 A 5/2017

OTHER PUBLICATIONS

"ExitPoint," (c) 2007 System Sensor.

*Primary Examiner* — Curtis J King
(74) *Attorney, Agent, or Firm* — Nath, Goldberg & Meyer; Richard C. Litman

(57) ABSTRACT

The auditory and visual guidance system for emergency evacuation includes one or more single track auditory and visual guidance systems. Each of the single track auditory and visual guidance systems includes a continuous ovoid track and at least one mobile guidance device mounted on the track and moveable around the track. The single track auditory and visual guidance system is attached to the ceiling or walls of the covered area. Each of the mobile guidance devices includes a speaker and optionally a downwardly pointing laser that receives signals from a computer. A number of emergency detectors are mounted in the covered area and provide emergency signals to the computer. When an emergency is detected, the computer activates the mobile guidance devices to move around the track, and activates the laser and speaker on any mobile guidance devices that are traveling in the direction of the safest evacuation route.

17 Claims, 6 Drawing Sheets

(56) References Cited

U.S. PATENT DOCUMENTS 8,138,928 B2* 3/2012 Farley ..... G08B 5/36 340/577
8,457,324 B2 6/2013 Tice
8,970,354 B2 3/2015 Lewis
9,959,747 B1* 5/2018 Zupan ..... H04R 3/005
10,726,696 B1* 7/2020 DeLintt ..... G08B 21/02
10,769,902 B1* 9/2020 Kronz ..... H04W 4/38
2003/0189823 A1* 10/2003 George ..... G08B 7/066 362/84
2003/0190906 A1* 10/2003 Winick ..... G08B 25/008 455/404.1
2003/0234725 A1* 12/2003 Lemelson ..... G08B 29/186 340/521
2003/0234731 A1* 12/2003 Rhodes ..... G08B 17/10 340/870.09
2004/0145498 A1* 7/2004 Carroll ..... B64D 45/0015 340/945
2004/0257216 A1* 12/2004 Parker ..... G08B 29/18 340/507
2005/0212677 A1* 9/2005 Byrne ..... G08B 7/062 340/574
2005/0231349 A1* 10/2005 Bhat ..... G08B 25/08 340/506
2005/0242944 A1* 11/2005 Bankert ..... G08B 25/00 340/531
2005/0275549 A1* 12/2005 Barclay ..... G08B 13/1966 340/628
2006/0017565 A1* 1/2006 Addy ..... H04N 7/18 340/539.14
2006/0226972 A1* 10/2006 Smith ..... G08B 13/2482 340/539.1
2007/0008099 A1* 1/2007 Kimmel ..... G08B 13/19656 340/506
2008/0266121 A1 10/2008 Ellul
2009/0043439 A1* 2/2009 Barfoot ..... G05D 1/0297 701/25
2010/0043319 A1* 2/2010 Bennett ..... E04D 1/30 52/173.3
2010/0090856 A1* 4/2010 Chen ..... G08B 7/062 340/691.6
2010/0102983 A1* 4/2010 Plocher ..... G08B 25/012 340/691.6
2010/0153003 A1* 6/2010 Merkel ..... G08B 21/0476 701/533
2011/0040877 A1* 2/2011 Foisy ..... H04L 41/0893 709/226
2011/0157486 A1* 6/2011 Murata ..... H04N 9/3194 348/744
2011/0187543 A1* 8/2011 Russo ..... G08B 17/10 340/628
2011/0267179 A1* 11/2011 Patterson ..... G08B 7/066 340/286.02
2011/0286590 A1* 11/2011 Foisy ..... G08B 29/185 379/100.17
2011/0298616 A1* 12/2011 Foisy ..... G08B 29/06 340/540
2012/0126700 A1* 5/2012 Mayfield ..... H05B 47/19 315/86
2012/0139718 A1* 6/2012 Foisy ..... G08B 25/012 340/531
2012/0282974 A1* 11/2012 Green ..... G08B 13/19689 455/550.1
2013/0027197 A1* 1/2013 Foisy ..... G08B 25/014 340/506
2013/0054033 A1* 2/2013 Casilli ..... H04L 12/282 700/276
2013/0257626 A1* 10/2013 Masli ..... G08B 13/19613 340/691.6
2013/0261804 A1* 10/2013 Casilli ..... G05B 15/02 700/276
2014/0015667 A1* 1/2014 Kolb ..... G06F 11/0745 340/501
2014/0340222 A1* 11/2014 Thornton ..... G08B 7/062 340/539.17
2015/0179039 A1* 6/2015 Miwa ..... H04W 64/00 340/573.1
2015/0287295 A1* 10/2015 Trivelpiece ..... G08B 13/00 340/6.1
2015/0296188 A1* 10/2015 Meganathan .... G08B 13/19645 348/143
2015/0339913 A1* 11/2015 Lyman ..... G08B 5/38 340/287
2015/0348220 A1* 12/2015 Sharma ..... G08B 7/066 705/324
2015/0348399 A1* 12/2015 Cree ..... G06F 3/0488 340/514
2016/0007179 A1* 1/2016 Kim ..... G08B 7/066 455/404.1
2016/0027266 A1* 1/2016 Mc Donagh ..... G08B 7/066 340/815.4
2016/0247369 A1* 8/2016 Simmons ..... G08B 7/066
2016/0266556 A1* 9/2016 Pearson ..... G06F 30/13
2016/0275761 A1 9/2016 Tanaka et al.
2016/0284174 A1* 9/2016 Connell, II ..... G08B 7/062
2017/0018154 A1* 1/2017 Wen ..... G08B 27/001
2017/0352257 A1* 12/2017 Oliver ..... G08B 27/005
2018/0050226 A1* 2/2018 Park ..... A62B 3/00
2018/0089775 A1* 3/2018 Frey ..... H04L 67/02
2018/0101179 A1* 4/2018 Louey ..... B60L 50/52
2018/0197402 A1* 7/2018 Zribi ..... G08B 7/06
2018/0211512 A1* 7/2018 Zribi ..... G08B 21/02
2018/0227141 A1* 8/2018 Zribi ..... H04L 12/2825
2018/0356241 A1* 12/2018 Correnti ..... G01C 21/3461
2019/0130723 A1* 5/2019 Thiel ..... E05C 19/184
2019/0187699 A1* 6/2019 Salour ..... G05D 1/0246
2019/0295207 A1* 9/2019 Day ..... G06Q 90/205
2019/0295386 A1* 9/2019 Roberts ..... H02J 9/065
2019/0295397 A1* 9/2019 Eckert ..... G08B 15/00
2019/0318611 A1* 10/2019 Gravel ..... H04W 4/026
2020/0018093 A1* 1/2020 Szerszen ..... G09F 13/22
2020/0098209 A1* 3/2020 Zilka ..... G07C 9/00563
2020/0126400 A1* 4/2020 Larsson ..... H04W 4/90
2020/0168068 A1* 5/2020 Lyman ..... G08B 25/12
2020/0175842 A1* 6/2020 Merjanian ..... G06T 11/60
2020/0194310 A1* 6/2020 Yamazaki ..... H01L 21/8234
2020/0226892 A1* 7/2020 Coles ..... G01S 5/22
2020/0349827 A1* 11/2020 Joshi ..... G09F 13/04
2020/0357309 A1* 11/2020 Paolini, Jr. ..... G09F 9/372
2020/0371496 A1* 11/2020 Abdeldaim ..... H04L 61/2007

* cited by examiner

AUDITORY AND VISUAL GUIDANCE SYSTEM FOR EMERGENCY EVACUATION

BACKGROUND

1. Field

The disclosure of the present patent application relates to emergency smart evacuation, and particularly, to an auditory and visual guidance system for emergency evacuation from a building or a floor of a building, a ship, a train or an airplane.

2. Description of the Related Art

Emergency evacuations are required in situations, such as school shootings, fire and bomb threats, to vacate an area, a building, or a floor of a building, a ship, a train, or an airplane that has become hazardous. In general, systems for providing guidance out of a hazardous area during an emergency evacuation are very limited. Examples include non-directional beacons mounted on walls that flash lights and sound loud sirens. While exits in many building corridors are indicated by a lighted sign, these are not visible unless the exit itself is visible, and are not equipped to provide guidance to the exit. In situations of low visibility, such as power outages or smoke, it can be difficult for evacuees to determine the direction to the closest safe exit, particularly if they are not familiar with the building or floor of the building they are trying to evacuate. In addition, many systems have limited effectiveness for those who are blind and/or hearing impaired.

Thus, an auditory and visual guidance system for emergency evacuation solving the aforementioned problems is desired.

SUMMARY

The auditory and visual guidance system for emergency evacuation includes one or more single track auditory and visual guidance systems. Each of the single track auditory and visual guidance systems includes a continuous track and one or more diametrically opposed mobile guidance devices movably mounted on the track. The single track auditory and visual guidance system is attachable to a ceiling or walls of a room or corridor. The system includes an opening under the track and two powered strips for supplying a DC voltage to the one or more mobile guidance devices. Each of the mobile guidance devices includes a body supported by four wheels, and contacts for contacting the powered strips and supplying the DC voltage to an electric motor for driving two of the wheels. In addition, each of the mobile guidance devices includes a downwardly pointing laser and a speaker that are controlled via Wi-Fi control signals from a central controller. A number of smoke detectors, emergency pull stations or other devices providing a Wi-Fi emergency signal to the central controller are mounted in the area of the auditory and visual guidance system. When an emergency is detected, the central controller sends Wi-Fi signals to the mobile guidance devices, to activate the laser and speaker on the mobile guidance device that is traveling in the direction of the safest evacuation exit. The moving activated speaker produces a localizable sound with Doppler effect that helps evacuees to identify the indicated direction of egress. In buildings with a number of interconnected corridors, each corridor is equipped with one or more track auditory and visual guidance system, and the one or more mobile guidance devices on each single track auditory and visual guidance system is controlled to indicate the safest route to an exit, which may require several turns to avoid the area of greatest danger.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
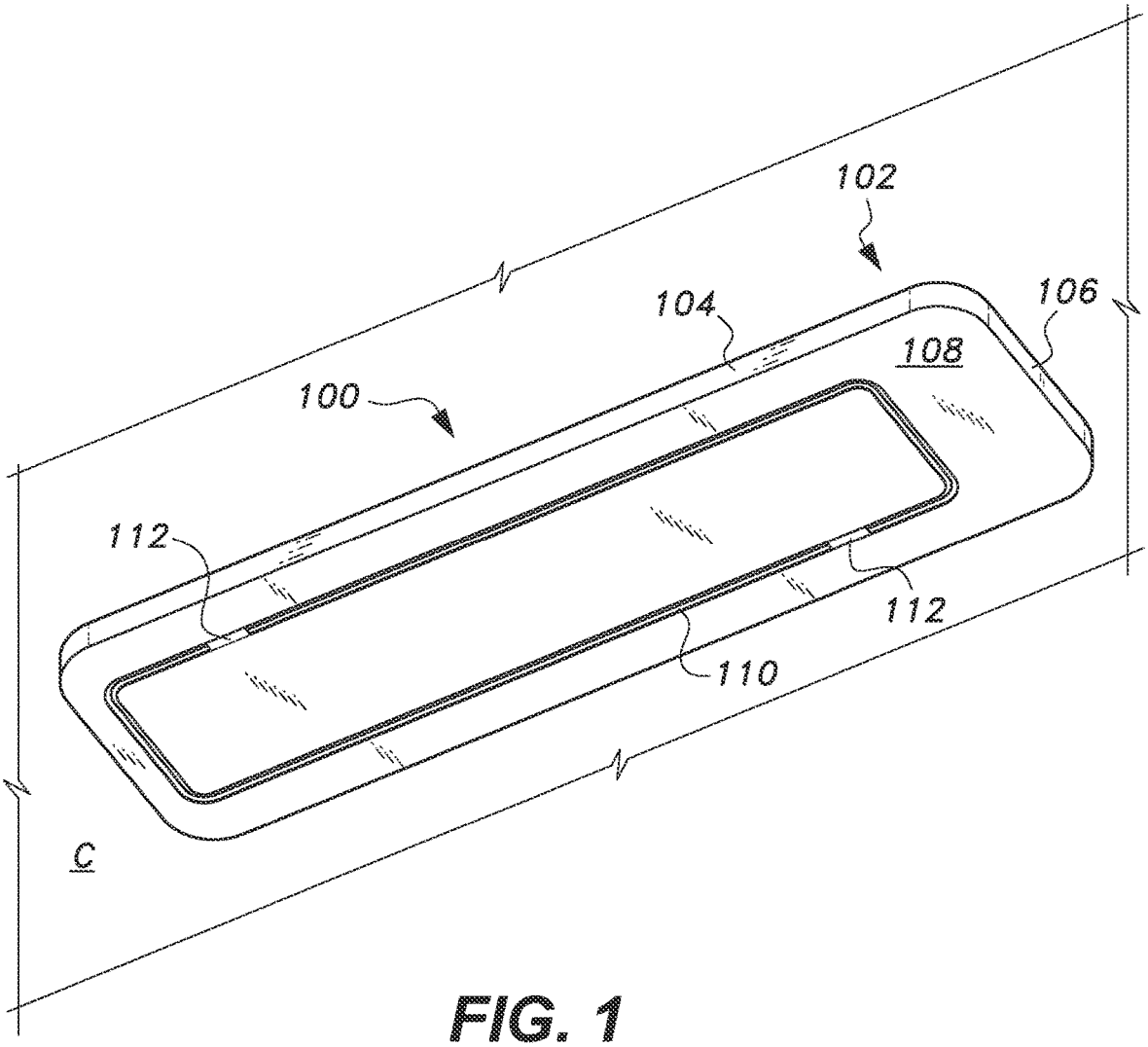
FIG. 1 is an environmental, perspective, bottom view of a single track auditory and visual guidance system for emergency evacuation.
Figure 2:
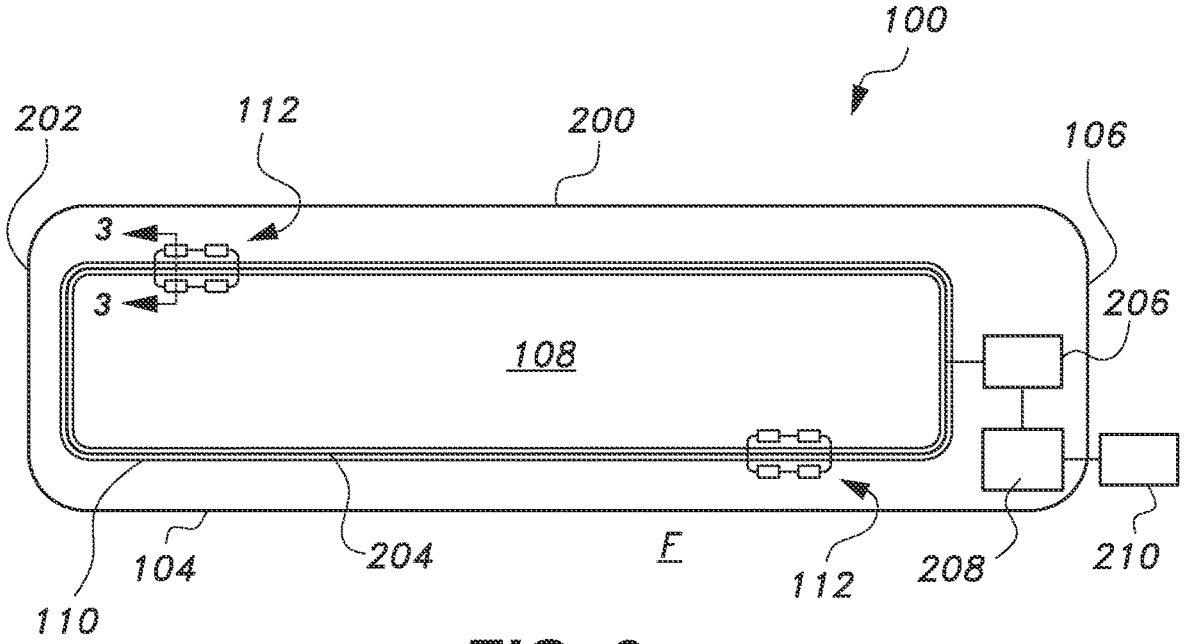
FIG. 2 is a top view of the single track auditory and visual guidance system for emergency evacuation of FIG. 1.

A single track auditory and visual guidance system for emergency evacuation 100 is shown in FIGS. 1-2. The single track auditory and visual guidance system for emergency evacuation 100 may be used alone for small applications, such as a short single corridor in a building. For larger applications, a number of systems 100 may be used together to adequately cover all corridors of a multi-corridor building, as described below with respect to FIGS. 5-6.

As shown in FIGS. 1-2, the single track auditory and visual guidance system 100 includes a fire resistant housing with a top panel 102 that is attached to a ceiling C or walls of a corridor or other area in a building for which evacuation guidance is desired. The housing of system 100 includes a first long side 104, a second long side 200, a first end 106, a second end 202 and a bottom panel 108. While the housing is shown in FIGS. 1-2 as a generally rectangular structure with rounded corners, other shapes can be selected to cover the particular corridor or other building area as effectively as possible.

The bottom panel 108 includes an opening 110, e.g., oval-shaped, through which auditory signals emitted from mobile guidance devices 112 can be heard and visual guidance signals displayed from the mobile guidance devices 112 can be seen on the floor. While two mobile guidance devices 112 are shown, it should be understood that one or more than two mobile guidance devices 112 can be provided depending on the size of the single track system 100. A track 204, above the opening 110, provides switched DC power to mobile guidance devices 112, as further described with respect to FIGS. 3-4. The power to the track 204 can be provided by a track control circuit 206 which is powered by a lithium battery 208, to thereby provide power to the track 204 in the event of a power outage, which is often associated with emergency evacuation scenarios. The lithium battery 208 is connected to a DC power source 210, (such as an AC/DC converter) to charge the battery while power is available.

Figure 3:
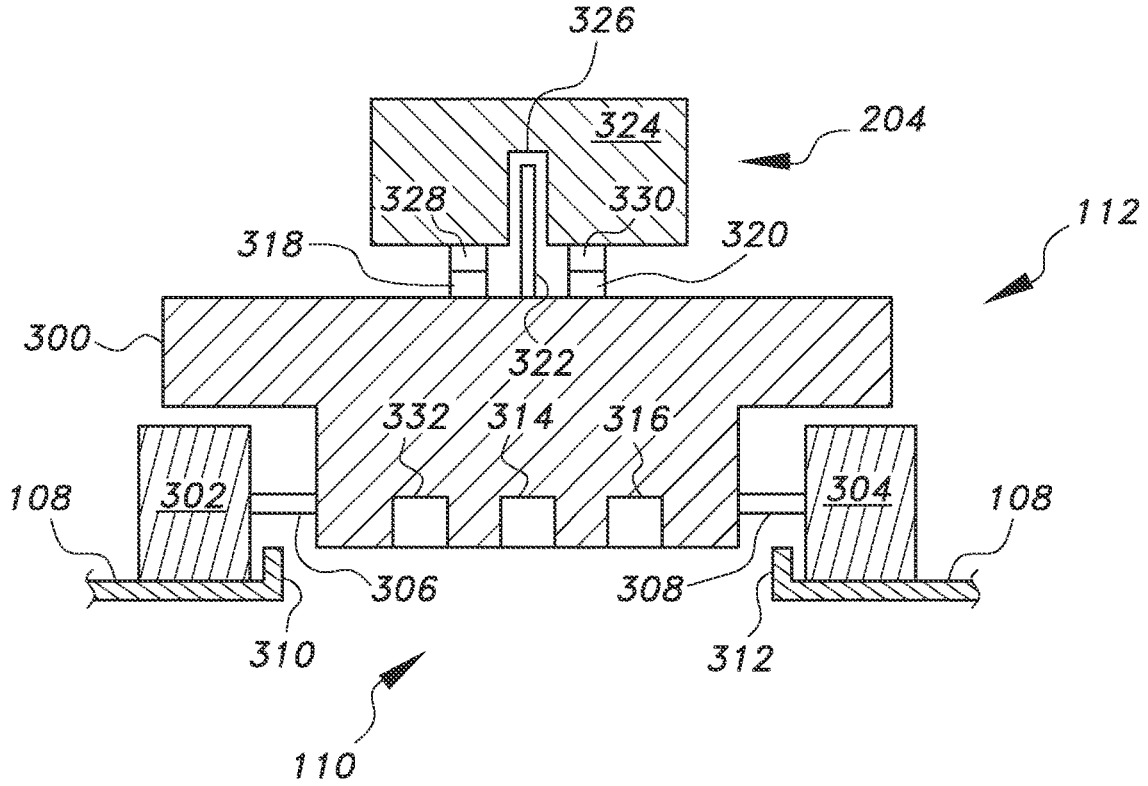
FIG. 3 is a cross-sectional view through line 3-3 of FIG. 2.
Figure 4:
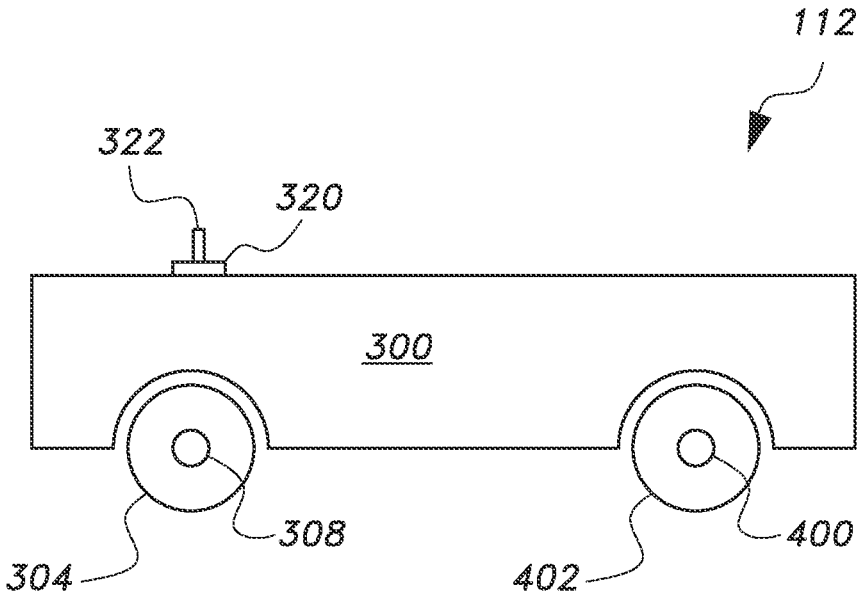
FIG. 4 is a side view of a mobile guidance device of the auditory and visual guidance system for emergency evacuation of FIG. 1.

Referring to FIGS. 3-4, an embodiment of the mobile guidance device 112 includes a body 300 for housing components of the mobile guidance device 112, a front outer wheel 302 that is rotatably attached to the body 300 by a front outer axle 306, and a front inner wheel 304 that is rotatably attached to the body 300 by a front inner axle 308. Alternatively, the front outer axle 306 and the front inner axle 308 may be in the form of a single front axle, as the front wheels 302, 304 are free-wheeling and not driven in at least this embodiment. The rear of the body 300 includes an inner rear wheel (not shown) and an outer rear wheel 402. The rear wheels are mounted on an axle 400 that is driven by an electric motor (not shown). The top surface of the body 300 of the mobile guidance device 112 includes a first mobile device electrical contact 318, a second mobile device electrical contact 320 and a guiding pin 322. The electric motor is electrically connected to the mobile device electrical contacts 318, 320, for receiving a DC voltage therefrom. The track 204 includes a track body 324 with a central slot or channel 326, through which the pin 322 of the mobile guidance device 112 extends. The bottom of the track body 324 includes a first track electrical strip 328 and a second track electrical strip 330. The mobile device electrical contacts 318, 320 are in contact with the track electrical strips 328, 330, respectively, as the mobile guidance device 112 travels around the track. Electrical power from the track can be supplied to the electric motor as is generally known in the art for slot car-type toys, such as is shown and described in U.S. Pat. No. 4,615,686 A. Although the mobile guidance device 112 has been described to include a slot car-type structure, it should be understood that the mobile guidance device 112 can include any suitable structure configured for movement or any suitable movement mechanism.

The bottom of the body 300 of the mobile guidance device 112 includes a downwardly directed speaker or buzzer 314 and a downwardly directed visible laser pointer 316. The speaker 314 emits audio signals, while the downwardly directed visible laser pointer 316 provides emissions that are visible on a floor F of the evacuation area as arrows or other symbols. In an emergency, the audio signals and the light indicators can direct people toward the safest evacuation direction, as described below with respect to FIGS. 5-6. The bottom panel 108 includes an outer upwardly extending flange 310 and an inner upwardly extending flange 312, that cooperate with the pin 322 and slot 326 to guide the mobile guidance device 112 around the track by contacting the wheels 302, 304, and 402.

Figure 5:
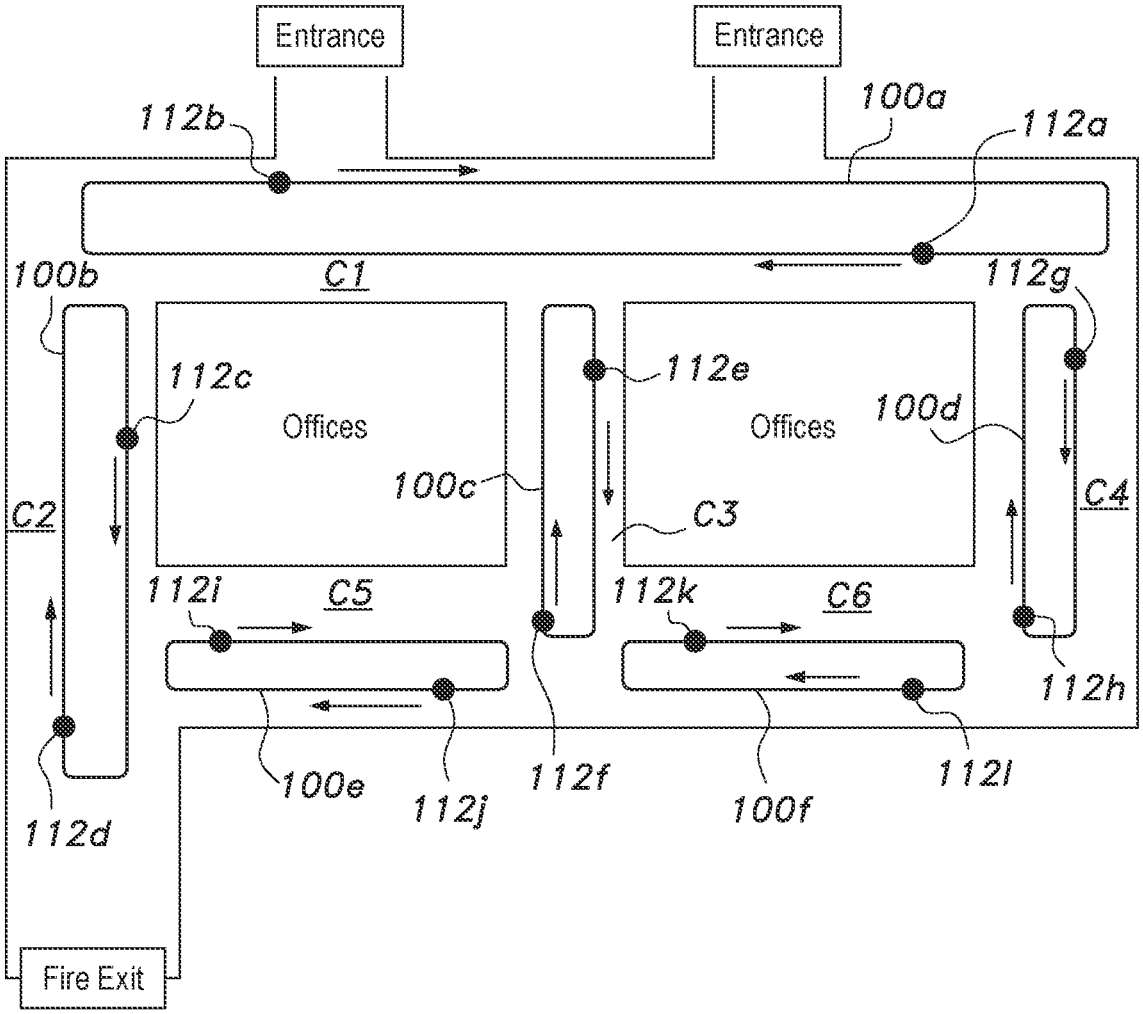
FIG. 5 is a schematic top view of a multi-track system including six of the single track auditory and visual guidance systems for emergency evacuation of FIG. 1.
Figure 6:
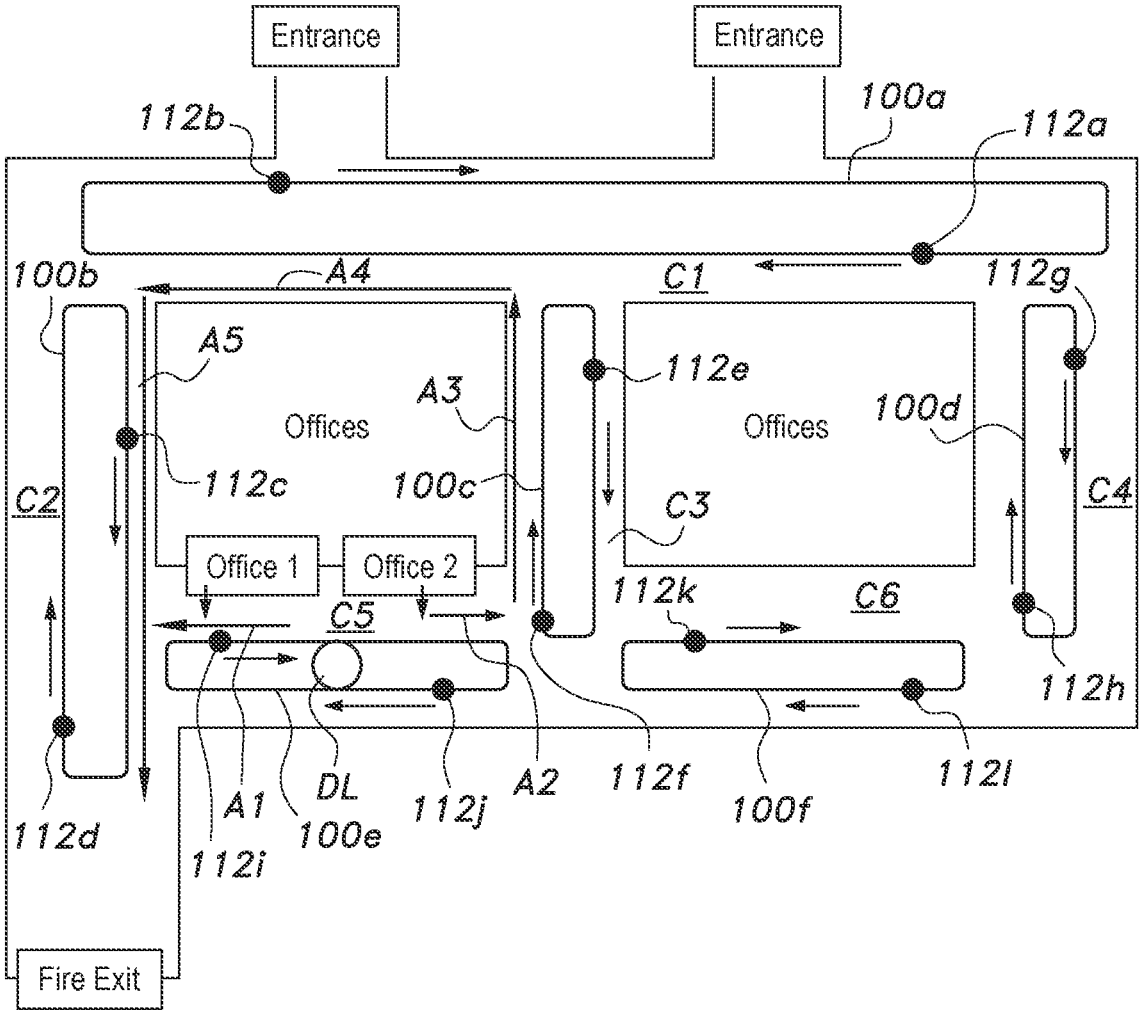
FIG. 6 is a schematic top view of the multi-track system of FIG. 5, after a fire has been detected.

FIGS. 5-6 show one implementation of the auditory and visual guidance system for emergency evacuation in a multi-corridor floor of a building. The floor includes six corridors C1-C6, each corridor having a single track auditory and visual guidance system 100*a*-100*f*, respectively. A fire exit is shown on the lower left hand side of the drawings, located at the lower end of corridor C2. The guidance system 100*a* includes two mobile guidance devices 112*a*, 112*b*. The guidance system 100*b* includes two mobile guidance devices 112*c*, 112*d*. The guidance system 100*c* includes two mobile guidance devices 112*e*, 112*f*. The guidance system 100*d* includes two mobile guidance device 112*h*, 112*g*. The guidance system 100*e* includes two mobile guidance devices 112*i*, 112*j*. The guidance system 100*f* includes two mobile guidance devices 112*k*, 112*l*.

Figure 7:
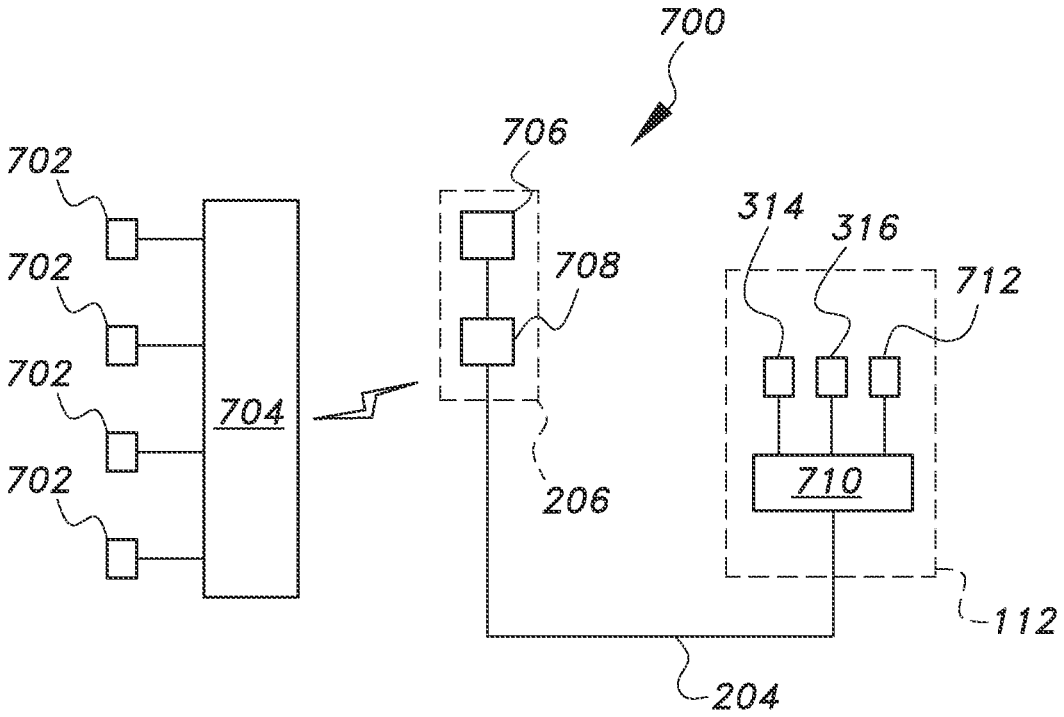
FIG. 7 is a block diagram of an electrical control system of the auditory and visual guidance systems for emergency evacuation of FIGS. 1 and 5.

A scenario of a guided emergency evacuation will be described with respect to FIGS. 6-7. FIG. 7 is a block diagram of an electrical system 700 of the auditory and visual guidance system for emergency evacuation. The system 700 includes a plurality of fire, smoke or other emergency detectors 702. It should be understood that while only four emergency detectors 702 are shown as an illustration, there are generally several detectors installed in each corridor. When an emergency is detected, the detector or detectors 702 send an emergency signal to a computer 704. While the detectors 702 are shown electrically connected to the computer 704, they may be wirelessly connected to the computer 704 using Wi-Fi, for example. When the computer 704 receives an emergency signal, a computer program stored in memory in the computer 704 first determines where the emergency or emergencies are located, based on stored location information for each emergency detector 702. Based on the location of the emergency, the computer 704 uses a Wi-Fi router to send an "on" signal to Wi-Fi receivers 706 of track control circuits 206 of selected single track auditory and visual guidance systems 100*a*-100*f*. The Wi-Fi relays may be distributed in the covered area to extend the range of the computer's Wi-Fi router. Each Wi-Fi receiver 706 that receives the "on" signal, activates a track control 708 to connect the battery 208 to the track 204, thereby causing each of the mobile guidance devices 112*a*-1 to continuously traverse their respective track 204. The computer 704 also sends a signal to a Wi-Fi receiver 712 in each of the mobile guidance devices 112*a-l*. The Wi-Fi receiver 712 sends the signal to a mobile guidance device controller 710, which selectively activates or deactivates the speaker 314 and the laser pointer 316 to indicate the safest direction of exit, as described further below.

FIG. 6 illustrates an exemplary emergency evacuation scenario and system response of the auditory and visual guidance system. In the scenario, a location of a source of danger DL (e.g., fire in the corridor) has been identified by the computer 704 based on signals from one or more emergency detectors 702. The emergency detectors 702 can be arranged on the walls and/or ceilings of the corridors C1-C6. The computer 704 sends an "on" signal to Wi-Fi receivers 706 of the track control circuits 206 to activate the mobile guidance devices 112*a-l* to continuously traverse their respective track 204. Based on the location DL and the stored location of the fire exit, the computer 704 determines the safest path toward the exit from each corridor and sends a signal to each Wi-Fi receiver 712 in each of the mobile guidance devices 112*a*-1 to activate the speaker 314 and the laser pointer 316 of the respective mobile guidance devices 112*a-l* accordingly. Since, for example, mobile guidance device 112*a* moves in the opposite direction of 112*b*, when mobile guidance device 112*a* is moving in the safest direction of exit (i.e., towards C2), the speaker 314 and laser pointer 316 of mobile guidance device 112*a* are activated and the speaker 314 and laser pointer 316 of mobile guidance device 112*b* are deactivated while moving towards C4. Then, upon reaching the end of the track, the speaker 314 and laser pointer 316 of mobile guidance device 112*a* are deactivated as it prepares to move in the opposite direction down the track (i.e., towards C4) and the speaker 314 and laser pointer 316 of mobile guidance device 112*b* are activated while moving towards C2. The localizable sound emitted from the moving activated speakers 314 and the doppler effect caused by their movement provide a distinct audio indication of direction of motion, in addition to a sense of urgency. The auditory signal from the speakers can be a white noise signal or a tonal broadband or narrow band frequency signal and can be level-adjusted based on the background noise level as sensed by a microphone 332. The white noise signal and tonal broadband frequency signal may be desirable due to their localization advantage. The moving laser pointer 316 can create a moving dot, arrow, or other symbol on the floor F of the corridor C1, to provide a visual indicator of the safest path toward the exit.

An exemplary escape route from Offices 1 and 2 is provided by the arrows in FIG. 6. In corridor C5, when a person exits Office 1, the mobile guidance devices 112*i* and 112*j* direct the person to exit to their right toward corridor C2 (escape direction A1). This is achieved by activating the speakers in mobile guidance device 112*i* and 112*j* only after they pass DL towards C2. Upon reaching corridor C2, the mobile guidance devices 112*c* and 112*d*, prompt the person to turn left and then to the Fire Exit (escape direction A5). Also in corridor C5, when a person exits Office 2, the mobile guidance devices 112*i* and 112*j*, prompt the person to exit to the left toward corridor C3 (escape direction A2). This is achieved by activating the speakers in mobile guidance devices 112*i* and 112*j* only after they pass DL towards C3. Upon reaching corridor C3, the mobile guidance devices 112*e* and 112*f* prompt the person to turn left toward corridor C1 (escape direction A3). Upon reaching corridor C1, the mobile guidance devices 1/2*a* and 112*b*, prompt the person to turn left toward corridor C2 (escape direction A4). Upon reaching the corridor C2, the mobile guidance devices 112*c* and 112*d*, prompt the person to turn left toward the Fire Exit (escape direction A5). As illustrated by the above-described scenario, the use of multiple single track auditory and visual guidance systems in multiple corridors can readily direct evacuees to the safest route to an exit, even when the safest route requires several turns to avoid the area of greatest danger.

It is to be understood that the auditory and visual guidance system for emergency evacuation is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A guidance system for emergency evacuation, comprising:

at least one single track guidance system, the at least one single track guidance system including:

a housing having side panels and a bottom panel, the bottom panel having an opening therein;

a continuous track mounted in the housing above the opening;

at least one mobile guidance device, the at least one mobile guidance device having means for driving about the continuous track and a speaker;

a computer including memory; and a computer program stored in the memory, the computer program having means for determining an emergency location based on emergency detector location data stored in the memory, activating the means for driving the at least one mobile guidance device about the continuous track to drive the at least one mobile guidance device about the continuous track; and sending a signal to the speaker of the at least one mobile guidance device, such that the speaker is activated to transmit an audio signal when the at least one mobile guidance device is moving in a direction of safest evacuation and is deactivated when the at least one mobile guidance device is moving opposite to the direction of safest evacuation; and a plurality of emergency detectors having means for sending an emergency signal to the computer when at least one of the emergency detectors detects an emergency.

2. The guidance system for emergency evacuation as recited in claim 1, wherein the track further comprises:

a track body with a channel, a first track electrical strip and a second track electrical strip;

a power supply; and a track control circuit.

3. The guidance system for emergency evacuation as recited in claim 2, wherein each of the at least one mobile guidance device further comprises:

a body having a top surface, a bottom surface, and two sides;

at least two axles extending from the sides of the body;

a plurality of wheels mounted on the at least two axles;

a pin connected to a surface of the body and extending into the channel of the track body;

a first mobile device electrical contact attached to the surface of the body and contacting the first track electrical strip;

a second mobile device electrical contact attached to the surface of the body and contacting the second track electrical strip; and wherein the means for driving comprises an electrical motor mounted in the body, the electrical motor being electrically connected to the first and second mobile device electrical contacts and mechanically connected to one of the axles, to thereby drive the at least one mobile guidance device around the continuous track when power is applied to the first and second track electrical strips.

4. The guidance system for emergency evacuation as recited in claim 3, wherein the computer sends an activating signal to the track control circuit of the at least one single track guidance system to prompt the track control circuit to connect the power supply to the first track electrical strip and the second track electrical strip.

5. The guidance system for emergency evacuation as recited in claim 1, wherein:

each of the at least one mobile guidance device further comprises a downwardly pointing laser; and the computer is configured to send a signal to the downwardly pointing laser of the at least one mobile guidance device, such that the laser is activated to transmit a laser beam through the opening in the bottom panel when the at least one mobile guidance device is moving in a direction of safest evacuation and deactivated when the at least one mobile guidance device is moving opposite to the direction of safest evacuation.

6. The guidance system for emergency evacuation as recited in claim 1, wherein the at least one mobile guidance device comprises at least two mobile guidance devices.

7. The guidance system for emergency evacuation as recited in claim 1, wherein the at least one single track guidance system comprises a plurality of single track guidance systems.

8. The guidance system for emergency evacuation as recited in claim 1, wherein the audio signal transmitted by the speaker is selected from the group consisting of a white noise signal, a tonal broadband, and a narrow band frequency signal.

9. The guidance system for emergency evacuation as recited in claim 1, wherein:

the at least one mobile guidance device further comprises a microphone; and the audio signal transmitted by the speaker is level-adjusted based on a background noise level sensed by the microphone.

10. A method of guiding people to an exit for emergency evacuation, the method comprising the steps of:

providing the guidance system for emergency evacuation of claim 1;

detecting an emergency using at least one of the emergency detectors;

determining an emergency location;

activating the speaker to transmit an audio signal when the at least one mobile guidance device is moving in a direction of safest evacuation based on the emergency location; and deactivating the speaker when the at least one mobile guidance device is moving opposite to the direction of safest evacuation.

11. The method of guiding people to an exit for emergency evacuation as recited in claim 10, wherein the audio signal is selected from the group consisting of a white noise signal, a tonal broadband, and a narrow band frequency signal.

12. The method of guiding people to an exit for emergency evacuation as recited in claim 11, wherein:

the at least one mobile guidance device further comprises a microphone; and the audio signal transmitted by the speaker is level-adjusted based on a background noise level sensed by the microphone.

13. The method of guiding people to an exit for emergency evacuation as recited in claim 11, wherein the at least one mobile guidance device comprises at least two mobile guidance devices.

14. The method of guiding people to an exit for emergency evacuation as recited in claim 11, wherein the at least one mobile guidance device further comprises a laser, the laser being configured to transmit a laser beam from the at least one mobile guidance device when the at least one mobile guidance device is moving in the direction of safest evacuation.

15. The method of guiding people to an exit for emergency evacuation as recited in claim 14, wherein the activating step comprises:

activating the laser to transmit a laser beam in the mobile guidance devices moving in the direction of safest evacuation; and deactivating the laser in the mobile guidance devices moving opposite to the direction of safest evacuation.

16. The method of guiding people to an exit for emergency evacuation as recited in claim 15, wherein the at least one mobile guidance device comprises more than two mobile guidance devices.

17. The method of guiding people to an exit for emergency evacuation as recited in claim 15, wherein the laser is a downwardly pointing laser.

* * * * *